United States Patent [19]

Ness

[11] 4,258,863

[45] Mar. 31, 1981

[54] FLEXIBLE DISPENSING CONTAINER HAVING INTERNAL CONTAINER WALL RUPTURING MEANS

[76] Inventor: Richard A. Ness, Rte. 6, Fergus Falls, Minn. 56537

[21] Appl. No.: 1,533

[22] Filed: Jan. 8, 1979

[51] Int. Cl.[3] ..... B65D 17/42

[52] U.S. Cl. ..... 222/83; 128/249; 206/222; 222/94

[58] Field of Search ..... 222/81, 83, 94; 206/222, 601, 603; 401/132, 14, 135, 193, 134; 128/249

[56] References Cited

U.S. PATENT DOCUMENTS

| | | | |
|---|---|---|---|
| 2,642,064 | 6/1953 | Lawshe | 222/83 X |
| 2,753,105 | 7/1956 | Werner et al. | 206/603 |
| 2,849,321 | 8/1958 | Lhermite et al. | 206/603 X |
| 2,898,744 | 8/1959 | Robbins | 222/81 X |
| 2,907,173 | 10/1959 | Robbins | 222/81 X |
| 2,908,601 | 10/1959 | Brown | 222/541 X |
| 2,916,886 | 12/1959 | Robbins | 222/81 X |
| 3,239,105 | 3/1966 | Woodson | 222/94 |
| 3,255,923 | 6/1966 | Soto | 206/603 |
| 3,397,820 | 8/1968 | Smith | 222/83 |
| 3,543,966 | 12/1970 | Ryan et al. | 222/101 X |
| 3,596,801 | 8/1971 | Barnack | 222/81 |
| 3,652,174 | 3/1972 | Boone | 401/132 X |
| 3,736,933 | 6/1973 | Szabo | 222/94 X |
| 3,882,999 | 5/1975 | Wellman | 222/81 X |
| 3,889,804 | 6/1975 | Ravich | 401/132 X |
| 3,930,500 | 1/1976 | Marke et al. | 128/249 X |
| 3,981,304 | 9/1976 | Szpur | 222/81 X |

FOREIGN PATENT DOCUMENTS

| | | | |
|---|---|---|---|
| 2518929 | 11/1976 | Fed. Rep. of Germany | 206/603 |

*Primary Examiner*—Joseph J. Rolla
*Assistant Examiner*—Frederick R. Handren
*Attorney, Agent, or Firm*—Merchant, Gould, Smith, Edell, Welter & Schmidt

[57] ABSTRACT

An envelope-like packet defining a closed chamber for fluid to be dispensed and having side walls, at least one of which is flexible, and a rupturable end portion. An extensible envelope rupturing member is disposed in the chamber and includes an envelope rupturing point directed toward said rupturable portion. The rupturing member has spaced portions engaging the side walls, and is responsive to inward pressure imparted to said side walls against said spaced portions to extend the point into rupturing engagement with the rupturable portion of the envelope.

6 Claims, 18 Drawing Figures

FIG. 11
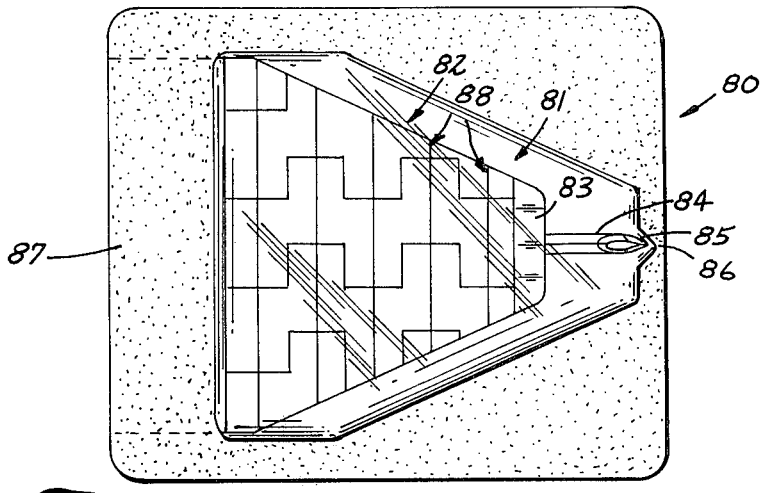
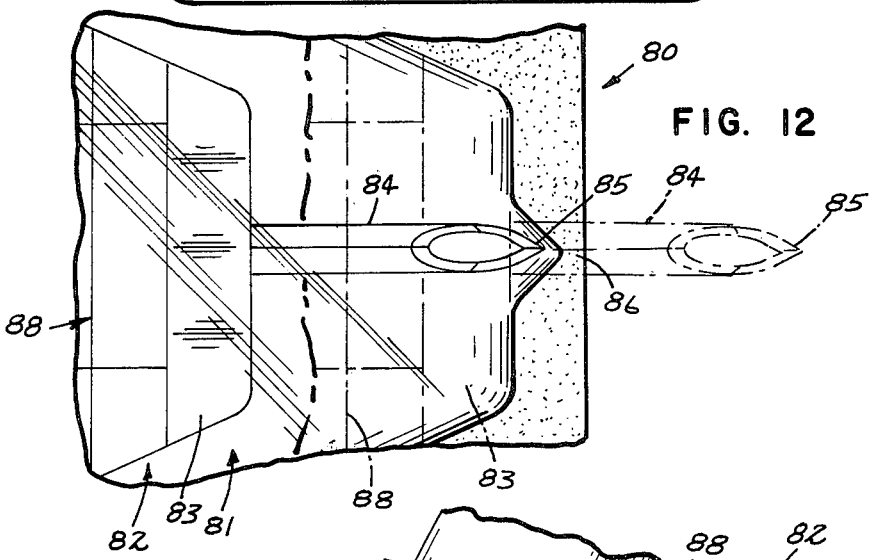
FIG. 12
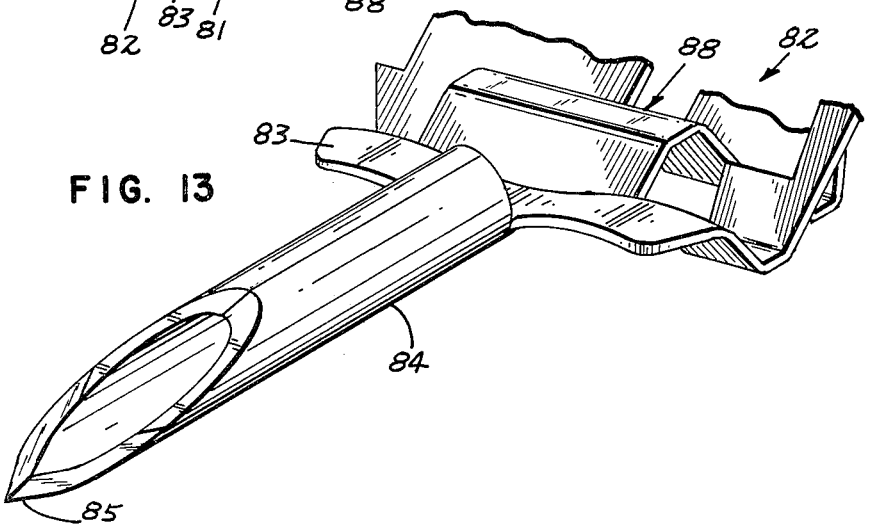
FIG. 13

FIG. 14
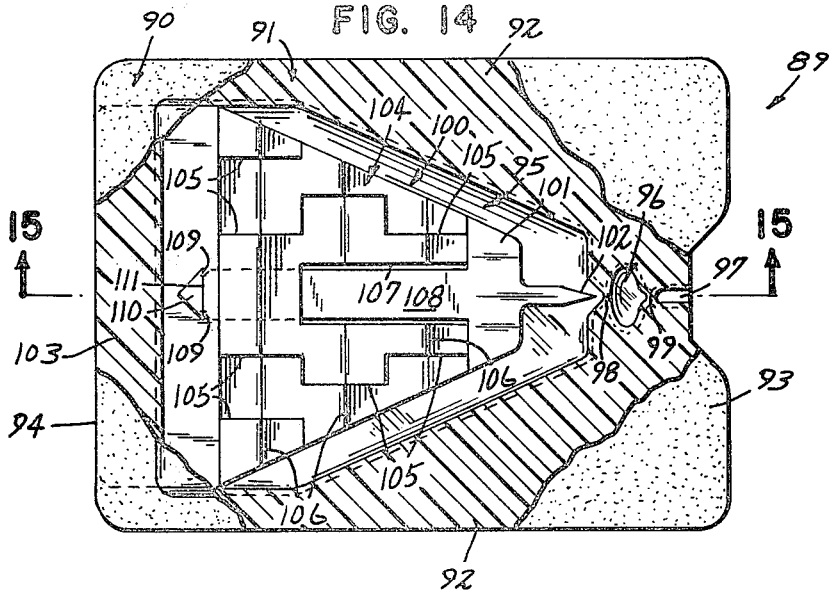
FIG. 15
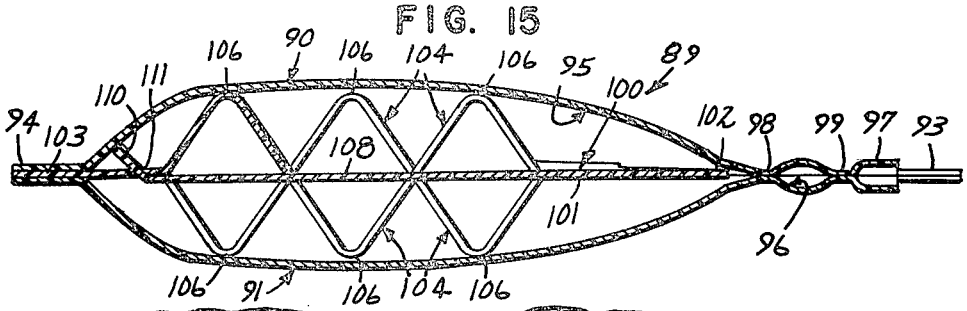
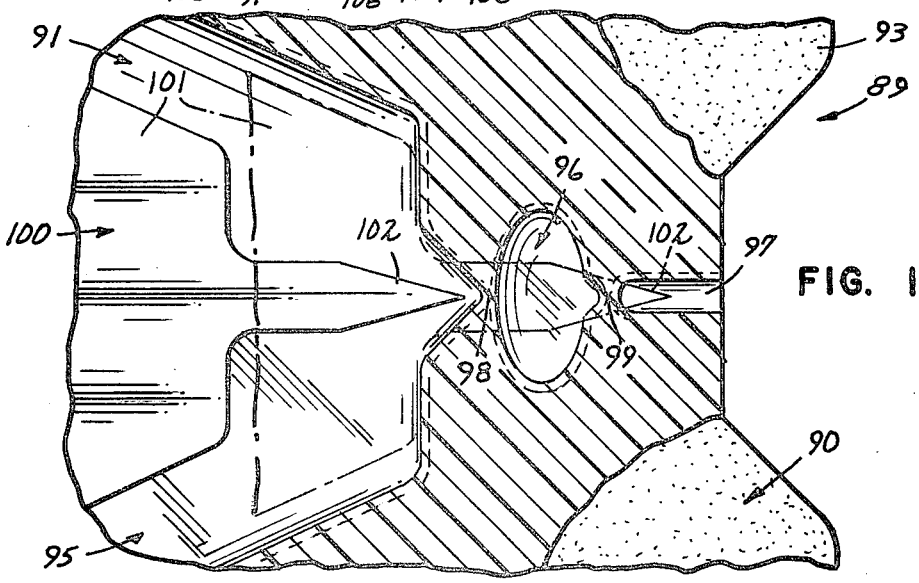
FIG. 16

FLEXIBLE DISPENSING CONTAINER HAVING INTERNAL CONTAINER WALL RUPTURING MEANS

BACKGROUND OF THE INVENTION

This invention relates generally to the packaging of small amounts of fluids, such as gases, liquids, or finely divided solids; and more particularly to such packages that are in the nature of envelope-like containers that are adapted to dispense the fluid by pinching the side walls thereof between one's fingers, and which, after a single use, may be discarded.

Known packets or envelope-like containers of some types require the use of both hands to open the container, so that material therein might be dispensed. Others have weakened portions that rupture or separate due to pressure of fluid therein when the side walls of such containers are pressed between one's fingers. In the latter type, it is difficult to control the velocity as well as the direction of discharge of fluid from the container as it bursts under pinching or compressing effort of the user's fingers thereagainst.

SUMMARY OF THE INVENTION

The dispensing container of this invention involves an envelope having side walls, at least one of which is flexible, and opposite side margins and end margins, said envelope defining a closed chamber for fluid inwardly of said margins. One of said margins includes a rupturable portion adjacent said chamber. Envelope rupturing means comprises an elongated longitudinally extensible member in said chamber, said member having one end portion defining a point directed toward said rupturable portion, and an opposite end disposed at the margin of said envelope opposite said rupturable portion. Said member has portions spaced apart in the direction of extending movement of said member and engageable with said opposite side walls. Said member is responsive to inward pressure of said side walls against said spaced apart portions to extend said point into rupturing engagement with said rupturable portion, whereby to produce communication between said chamber and the exterior of said envelope.

BRIEF DESCRIPTION OF THE DRAWINGS

FIG. 11 is a view corresponding to FIG. 1, but showing a still further modification;

FIG. 12 is an enlarged fragmentary view corresponding to a portion of FIG. 11;

FIG. 13 is an enlarged fragmentary view in perspective of a portion of the envelope rupturing member of FIGS. 11 and 12;

FIG. 14 is a view corresponding generally to FIG. 1, but showing a still further modification of the invention, some parts being broken away;

FIG. 15 is an enlarged longitudinal section taken on the line 15—15 of FIG. 14;

FIG. 16 is an enlarged fragmentary view corresponding to a portion of FIG. 14;

DETAILED DESCRIPTION OF THE EMBODIMENT ILLUSTRATED IN FIGS. 1-6

Figure 1:
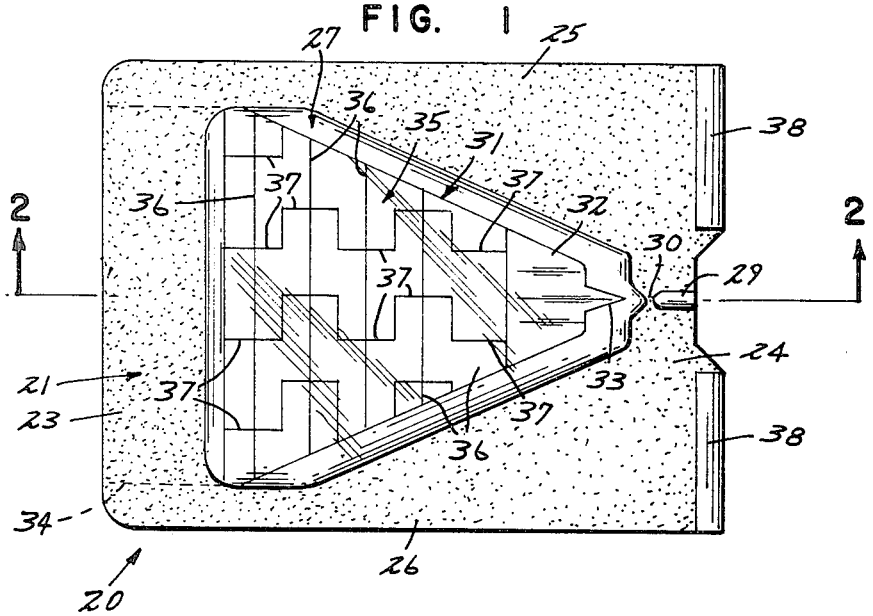
FIG. 1 is a view in top plan of a dispensing container produced in accordance with this invention.

An envelope-like container 20 is shown as being in the nature of an envelope having opposite sides 21 and 22 of flexible sheet material bonded together to provide opposite end margins 23 and 24, and side margins 25 and 26. The side walls, intermediate the margins 23-26 bulge outwardly away from each other to define a closed chamber 27 for reception of fluid to be dispensed, the fluid being indicated at 28. Depending upon the use for which the container is intended, the fluid 28 may be in the nature of a gas, liquid, or finely divided or powdered dry material. The container 20 may be made of any suitable flexible material such as synthetic plastics, metal foil, or other material which may be compatible with the fluid within the chamber 27.

The end margin 24 is formed to provide a tubular discharge portion 29 having an inner closed end disposed in closely spaced relation to the adjacent end of the chamber 27, the side walls 21 and 22 between the closed end of the discharge portion 29 and the chamber 27 forming a rupturable portion 30. An elongated longitudinally extensible member 31 is disposed in the chamber 27, and has an end portion 32 which defines a point 33 that is directed toward the rupturable portion 30 and discharge portion 29. The opposite end of the member 31 is indicated at 34, and is rigidly secured between the side walls 21 and 22 at the end margin 23 thereof.

Figure 5:
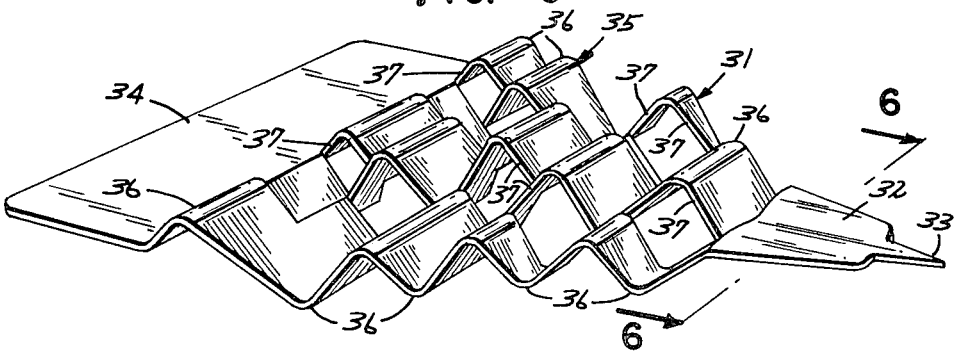
FIG. 5 is a view in perspective of the envelope rupturing member of FIGS. 1-3.
Figure 6:
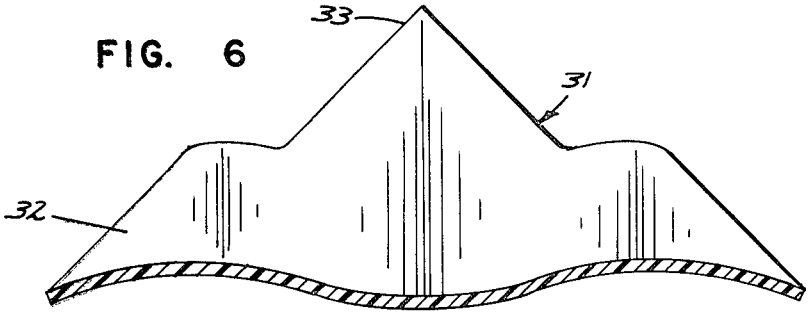
FIG. 6 is a further enlarged view partly in perspective and partly in section, taken on the line 6—6 of FIG. 5.

Intermediate its opposite end portions 32 and 34, the member 31 includes an actuating portion formed from a flat sheet material having outer margins or edges which generally conform to the inner edges of margins 23-26. The actuating portion is formed to provide a plurality of pleats or corrugations 35 that define folds or curved peaks 36 that are spaced apart longitudinally of the member 31 between the end portions 32 and 34 thereof. The corrugations 35 are each provided with slits 37 that are disposed in staggered relationship from one corrugation 35 to an adjacent corrugation. As shown in FIG. 5, the slits 37 divide each corrugation 35 into a plurality of corrugation sections, each section having its curved or peak portion 36 disposed adjacent an opposite one of the side walls 21 and 22 from its adjacent corrugation section, see particularly FIG. 2. With reference particularly to FIGS. 5 and 6, it will be seen that the end portion 32 is formed to provide a cross sectionally wave form so as to add rigidity to the portion 32 and point 33 in the direction of extending movement of the member 31 toward the rupturable portion 30 of the container 20.

Figure 2:
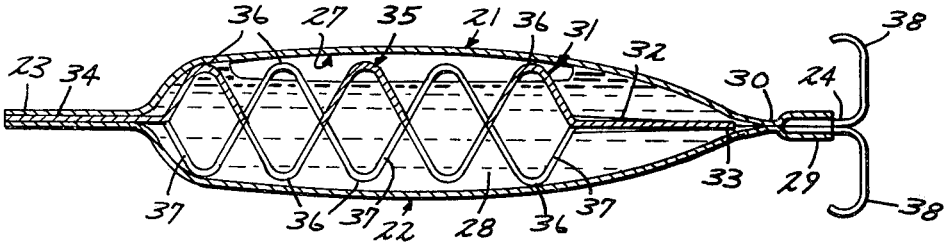
FIG. 2 is an enlarged longitudinal section taken on the line 2—2 of FIG. 1.
Figure 3:
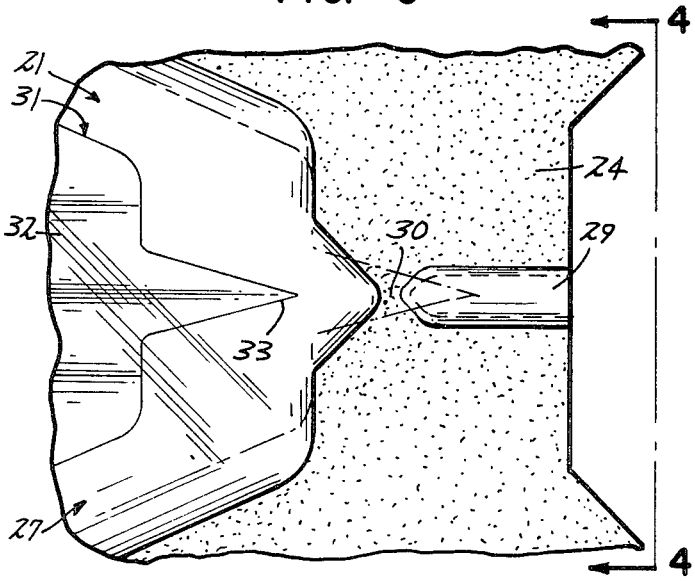
FIG. 3 is a further enlarged fragmentary view corresponding to a portion of FIG. 1.
Figure 4:
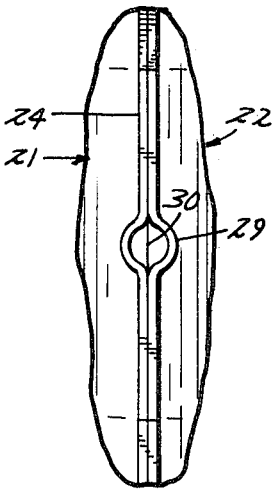
FIG. 4 is a fragmentary view in end elevation, as seen from the line 4—4 of FIG. 3.

Preferably, the chamber 27 is only partially filled with fluid material 28, so as to provide for an air space or bubble within the chamber 27, as shown in FIG. 2. When it is desired to use the fluid 28, it is only necessary for the operator to pinch or compress the side walls 21 and 22 between the operator's fingers, thereby placing inward pressure against the curved or peak portions 36 of the extensible member 31 to cause the point 33 thereof to move into rupturing engagement with the rupturable portion 30, as shown by broken lines in FIG. 3. The fluid 28, being under pressure due to the squeezing of the walls 21 and 22 toward each other, flows outwardly through the discharge portion 29 for application to the desired point. It will be understood that, for medical or other special purposes, the container 20 is of substantially smaller size than shown in the drawings, the chamber 27 preferably holding only a sufficient quantity of the fluid 28 for a single given application.

As shown in FIGS. 1 and 2, portions of the end margin 24 laterally outwardly of the discharge portion 29 thereof, are formed to provide outwardly projecting guard elements 38 which prevent the discharge portion 29 from approaching too closely to the surface to which the fluid 28 is to be applied. Thus, when the device is to be used for applying medicines to the human eye, the guard elements 38 aid in preventing the rupturing point 33 from touching the eye of the patient. It should here be noted that the extensible member 31 may be made from any suitable material such as synthetic plastic material that may be inert to the fluid 28 within the chamber 27. As shown, the tubular discharge portion 29 is of a sufficiently small diameter to direct the fluid 28 expressed from the chamber 27 over a small area, so that the fluid may be accurately applied where desired.

MODIFICATION OF FIG. 7

Figure 7:
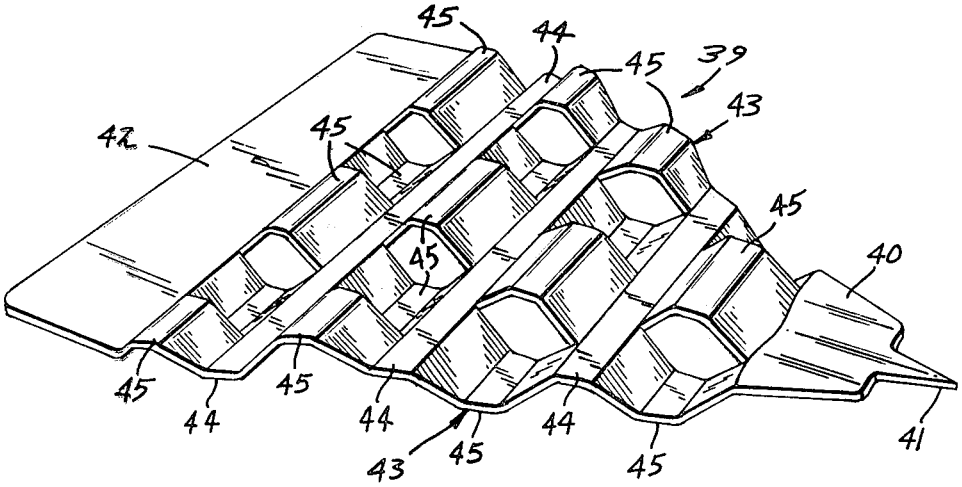
FIG. 7 is a view corresponding to FIG. 5, but showing a modified form.

The extensible rupturing member of FIG. 7 is similar in outline to the member 31, and is indicated generally at 39. The member 39 has an end portion 40 which defines a rupturing point 41 similar to the end portion 32 and point 33 of the member 31, and an opposite end portion 42 similar to the end portion 34 of the member 31. Intermediate the portions 40 and 42, the member 39 is corrugated somewhat in the manner of the member 31, the corrugations being indicated at 43. The corrugations 43 differ from the corrugations 35 in that they have intermediate flat portions 44 disposed generally in the plane of the end portions 40 and 42, and flattened tip portions 45 that are equivalent to the curved portions 36 of the member 31. It will be noted that the corrugations 43 are split in the same manner as the corrugations 35, to divide each corrugation 43 into corrugation sections that extend laterally in opposite directions from the plane of the intermediate portions 44 and end portions 40 and 42. Like the curved portions 36, the tip or peak portions 45 are adapted to engage the inner surfaces of the side walls of an envelope, not shown, but similar to the container 20.

MODIFICATION OF FIG. 8

Figure 8:
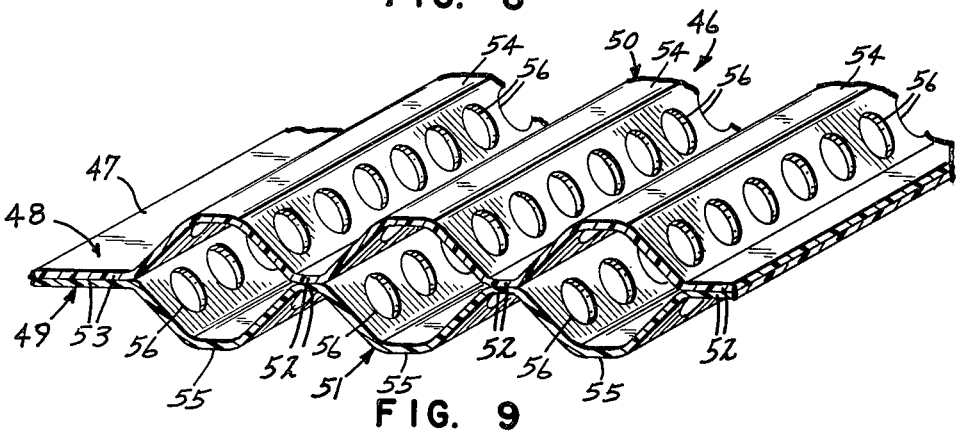
FIG. 8 is an enlarged fragmentary view corresponding to a portion of FIG. 7, but showing a further modification.

A modified extensible rupturing member 46 is shown fragmentarily in FIG. 8, and may be assumed to have a front end portion and rupturing point similar to the front end portion and rupturing points of the members 31 and 39. A rear end portion 47 is fragmentarily shown, this portion corresponding to the portions 34 and 42 of FIGS. 5 and 7, respectively. The member 46 is a composite member made of upper and lower layers 48 and 49 respectively, each being formed to provide corrugations 50 and 51 respectively, that are disposed in opposition to each other and which have portions 52 which are bonded together by heat or adhesives. The layers 50 and 51 have flat rear ends 53 that are bonded together and which cooperate to form the rear end portion 47, the portions 52 and 53 being coplanar. The corrugations 50 and 51 cooperate to provide spaced peak portions 54 and 55, respectively, that are engaged by respective ones of the side walls 21 and 22 when the member 46 is placed in a container 20. As shown in FIG. 8, the corrugations 50 and 51 are provided with openings 56 to permit free passage of fluid therethrough.

MODIFICATION OF FIG. 9

Figure 9:
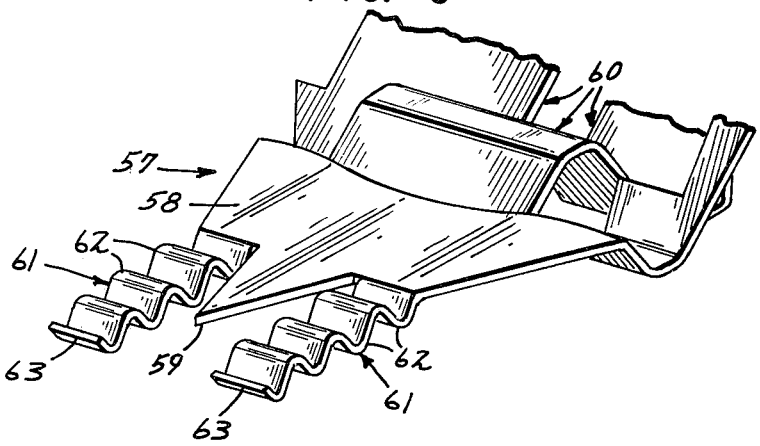
FIG. 9 is a fragmentary view in perspective showing a still further modified form of rupturing member.

In FIG. 9, an extensible rupturing member is shown fragmentarily and indicated generally at 57, the same having an end portion 58 terminating in a rupturing point 59, and spaced corrugations 60. In most respects, the member 57 may be assumed to be identical to the rupturing member 39, the corrugations 60 corresponding to the corrugations 43 of the member 39. The end portion 58, laterally outwardly of the rupturing point 59, is provided with a pair of resilient portions 61 that are bent to provide pleats or corrugations 62, the resilient portions projecting from the portion 58 in the same direction as the point 59. The outer ends 63 of the resilient portions 61 are adapted to engage the end of the chamber 27, when the member 57 is disposed in the container 20, to yieldingly urge the member 57 in a retracting direction and to yieldingly hold the point 59 away from the rupturable portion of the container. As shown, the resilient portions 61 may be integrally formed with the member 57 or, if desired, may be made from other suitable resilient material, and adhered to the portion 58.

MODIFICATION OF FIG. 10

Figure 10:
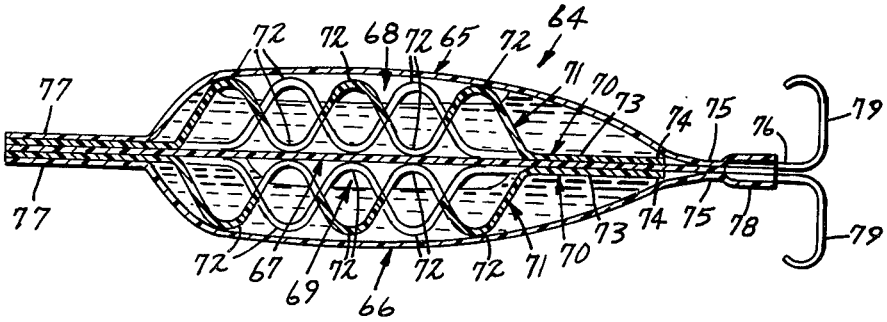
FIG. 10 is a view corresponding to FIG. 2, but showing a modified form of dispensing container.
Figure 17:
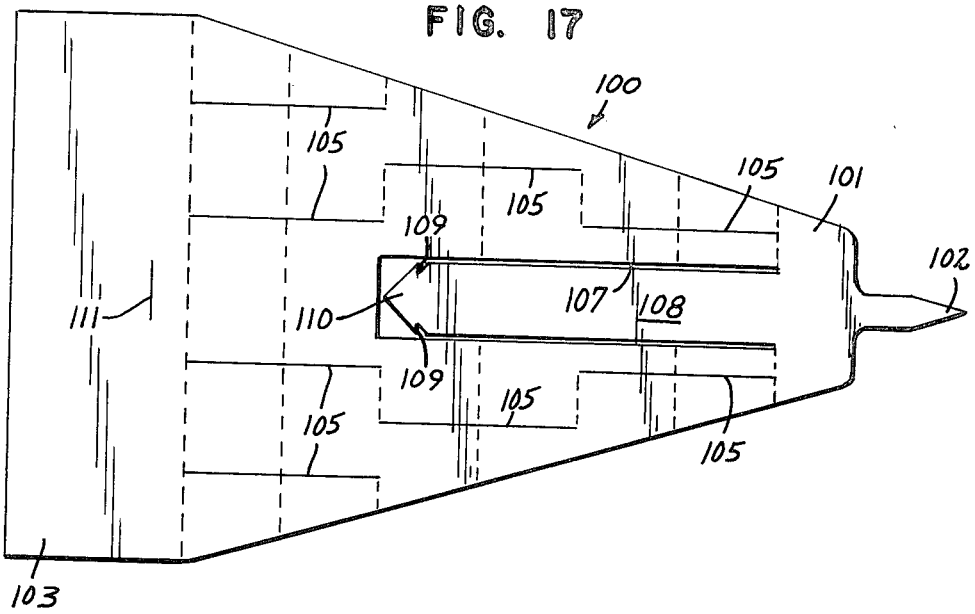
FIG. 17 is an enlarged view in top plan of the extensible envelope rupturing member of FIGS. 14 and 15, in flat form.

In FIG. 10, an envelope-like container, similar to the container 20, is indicated generally at 64, the same comprising a pair of opposite flexible side walls 65 and 66, similar to the side walls 21 and 22 respectively. The container 64 differs from the container 20 in that a partition 67 is disposed between the walls 65 and 66, the partition 67 dividing the chamber defined by the walls 65 and 66 into a pair of separate compartments 68 and 69. Each of the compartments 68 and 69 contains envelope rupturing means in the nature of one of a pair of extensible members 70 that are generally similar to the member 31, each of the members 70 having corrugations 71, the peak portions 72 of which engage respective sides of the partition 67 and respective side walls 65 and 66. Like the member 31, the members 70 have end portions 73 that terminate in points 74 that are directed toward rupturable portions 75 in the adjacent end margin 76 of the container 64. The ends of the members 70, opposite the end portions 73, are with the adjacent end of the partition 67, disposed between end margins 77 of the side walls 65 and 66 opposite the end margin 76 of the container 64. Like the container 20, the container 64 defines a tubular discharge portion 78 and guard elements 79. The apparatus of FIG. 10 is intended to hold fluids of different kinds within the compartments 68 and 69 so that, when the portions 75 are ruptured by squeezing the side walls 65 and 66 toward each other, the fluid discharged by the compartment 68 will become mixed with the fluid discharged from the compartment 69 in the discharge portion 78, for application to the desired area. Such an arrangement is particularly advantageous for use with medication wherein fluid ingredients must be mixed at the time of application, as well as for mixing small quantities of epoxy ingredients, and other liquid or powdered ingredients, or catalytic pairs.

MODIFICATION OF FIGS. 11-13

An envelope-like container 80 is similar to the container 20, having opposite side walls which cooperate to define a chamber 81 in which is mounted an extensible member 82 having an end portion 83 that is formed to provide an elongated tubular discharge conduit 84 having a sharp pointed outer end 85 that is adapted to rupture a rupturable portion 86 of the container 80. The end of the member 82 opposite the end 83 thereof is secured in the end margin 87 of the container 80 in the same manner as the member 31 in its container 20. With reference particularly to FIG. 13, it will be seen that the extensible member 82 is provided with corrugations 88 similar to the corrugations 35. As shown, the conduit portion 84 may be integrally formed with the member 82, but may, if desired, be formed from any suitable material and secured to the end portion 83, so as to be moved into rupturing engagement with the rupturable portion 86 and to extend outwardly therethrough as shown by broken lines in FIG. 12. This form of the invention is particularly adapted for use as a hypodermic syringe which, after having administered a predetermined dose of medication, may be discarded, so as to eliminate a possible source of contamination by repeated use.

MODIFICATION OF FIGS. 14-18

In FIGS. 14 and 15, an envelope-like container 89 is shown as being similar in construction to the containers 20 and 80, comprising upper and lower side walls 90 and 91 respectively, having sealed together side margins 92, and end margins 93 and 94. The flexible side walls 90 and 91 cooperate to define a compartment 95 for reception of fluid in the same manner as the containers 20 and 80. At its end margin 93, the side walls 91 and 92 define a second compartment 96 and a tubular discharge portion 97. The end margin 93 further includes a pair of rupturable portions 98 and 99, the former being disposed between the compartments 95 and 96, the portion 99 being disposed between the compartment 96 and the discharge portion 97. As shown in FIGS. 14 and 16, the rupturable portions are in alignment with the tubular discharge portion 97.

Container rupturing means in the nature of an extensible member 100 is disposed within the compartment 95, the same having one end portion 101 that is formed to provide a sharp pointed outer end 102 that is aligned with and directed toward the rupturable portions 98 and 99, the second compartment 96 and the discharge portion 97. The opposite end 103 of the member 100 is disposed between the side walls 90 and 91 at the end margin 94, and is suitably bonded therebetween.

Figure 18:
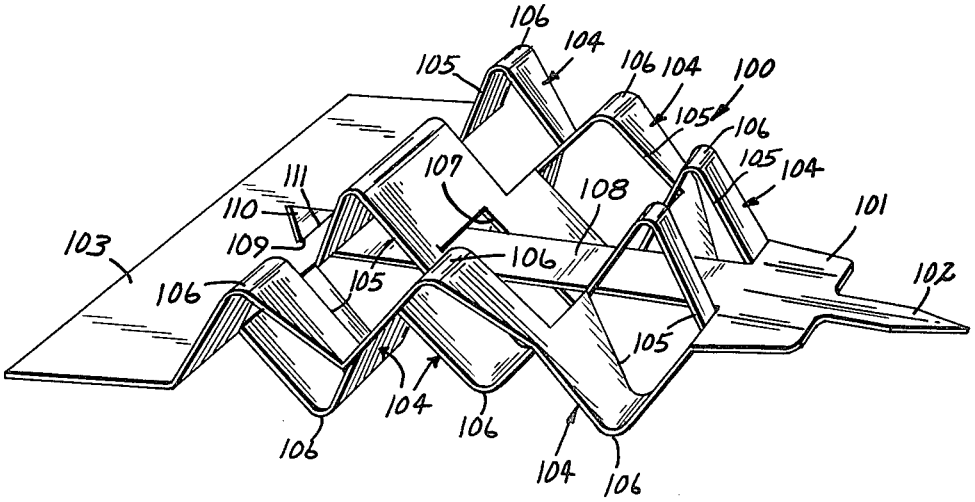
FIG. 18 is a view in perspective of the envelope rupturing member of FIGS. 14-17 in a folded or contracted form.

Intermediate its ends, the member 100 is formed similarly to the member 31, with corrugations 104 each of which is formed with slits 105 to divide the corrugations 104 into oppositely projecting sections in the manner of the corrugations 35. As shown in FIGS. 15 and 18, the corrugations have curved peak portions 106 that are engaged by respective ones of the walls 90 and 91 when the container 89 is pinched or squeezed, to impart elongation or extending movements to the member 100 to cause the point 102 to rupture the portions 98 and 99, whereby to effect communication between the compartments 95 and 96 and the discharge portion 97.

The member 100 differs from the member 31 by being formed to provide a longitudinally extending slot-like opening 107 and an elongated tie bar 108 extending longitudinally in the opening 107 and in alignment with the point 102. At one end, the tie bar 108 is formed with notches 109 at opposite side edges thereof, and a tapered head 110. The head 110 is adapted to be received within a transverse slit 111, in the end portion 103 of the member 100. The slit is slightly shorter than the width of the head 110, so that when the head 110 is forced through the slit 111, the ends of the slit 111 will be disposed in the notches 109. Thus, the tie bar 108 will effectively hold the corrugations in their bent form and prevent the point 102 from accidentally moving into rupturing engagement with the rupturable portions 98 and 99. The material of the member 100 is preferably somewhat flexible and resilient, so that when the container 89 is pinched or squeezed with sufficient force to cause the head 110 to be withdrawn from the slit 111, the point 102 will plunge through the rupturable portions 98 and 99 to effect communication between the compartments 95 and 96, and the discharge portion 97. When this occurs, fluids in the compartments 95 and 96 will become mixed together during discharge thereof from the container.

The arrangement illustrated in FIGS. 14-18 is highly effective as an atomizer, wherein a fluid substance such as a liquid or finely divided powder is disposed in the compartment 96, and a gas, such as air is disposed in the compartment 95. When the portions 98 and 99 are ruptured, gas from the compartment 95, being under pressure, will jet outwardly through the discharge portion, carrying with it a spray of material from the compartment 96.

While I have shown and described several forms of the present dispensing container, it will be understood that the same is capable of further modification without departure from the spirit and scope of the invention, as defined in the claims.

What is claimed is:

1. A dispensing container comprising:

(a) an envelope having opposite side walls, at least one which is flexible, and opposite side margins and end margins, said envelope defining a closed chamber for fluid inwardly of said margins;

(b) one of said margins including a rupturable portion adjacent said chamber;

(c) an envelope rupturing means comprising an elongated longitudinally extensible member in said chamber, said member having one end portion defining a point directed toward said rupturable portion and an opposite end disposed at the margin of said envelope opposite said rupturable portion;

(d) said member including an actuating portion formed from a flat sheet material having outer margins which generally conform to the margins of said envelope, said actuating portion including portions which are displaced from the plane of the sheet material to form corrugations having peaks which are spaced apart in the direction of extending movement of said member and engageable with said opposite side walls;

(e) said member being responsive to inward pressure of said side walls against said spaced apart peaks to extend said point into rupturing engagement with said rupturable portion, whereby to produce communication between said chamber and the exterior of said envelope.

2. The dispensing container defined in claim 1 in which at least some of said corrugations are each divided into a plurality of sections, each section having a peak portion engageable with a different envelope side wall than its adjacent section.

3. The dispensing container defined in claim 1 in which said member includes a tubular portion between said point and the one of said corrugations nearest said point, said tubular portion having its axis extending in the direction of extending and retracting movement of said member.

4. The dispensing container defined in claim 1, further including member retracting elements urging said point in a direction away from said rupturable portion, said retracting elements comprising a pair of resilient bent portions of said member and each disposed at an opposite side of said point, each of said bent portions having an end in engagement with said envelope adjacent said rupturable portion thereof.

5. A dispensing container comprising:

(a) an envelope having opposite flexible side walls, opposed side margins and opposite end margins;

(b) one of said end margins including a rupturable portion;

(c) a partition secured to said margins and dividing the interior of said envelope into a pair of compartments;

(d) each of said side walls forming one wall of a different one of said compartments;

(e) an envelope rupturing means comprising a pair of extensible and retractable members, one in each of said compartments, said members each having one end portion defining a point directed toward said rupturable portion adjacent a respective side of said partition, and an opposite end disposed at the other end margin of said envelope;

(f) said members each including an actuating portion formed from a flat sheet material having outer margins which generally conform to the margins of said envelope, said actuating portion including portions which are displaced from the plane of the sheet material to form corrugations having peaks which are spaced apart in the direction of extending and retracting movement of said members and engageable with said partition and respective ones of said side walls;

(g) said members being responsive to inward pressure of said walls against said peaks, toward said partition, to extend their respective points into rupturing engagement with said rupturable portion.

6. A dispensing container comprising:

(a) an envelope having opposite flexible side walls defining sides of a pair of separate fluid compartments, opposed side margins, and opposite end margins, one of said compartments being disposed in one of said end margins;

(b) said one of said end margins including a rupturable portion comprising an area between said compartments and another area between said one of the compartments and the exterior of said envelope;

(c) and elongated envelope rupturing means disposed between said opposite side walls and having an end directed towards said rupturable portions and an opposite end disposed at the margin of said envelope opposite said rupturable portion area;

(d) said rupturing means being longitudinally extensible and retractable and having corrugations with peak portions spaced apart longitudinally thereof and engageable with said sidewalls;

(e) said rupturing means being responsive to inward pressure of said side walls against said peak portions to extend into rupturing engagement with said rupturable portion areas, whereby to produce communication between said compartments and the exterior of said envelope.

* * * * *